US009004119B2

(12) United States Patent
Piper

(10) Patent No.: US 9,004,119 B2
(45) Date of Patent: Apr. 14, 2015

(54) PROTECTIVE COVER FOR USE WITH HANDBAGS AND A METHOD FOR ITS USE

(76) Inventor: Diane Piper, Alexandria, VA (US)

( * ) Notice: Subject to any disclaimer, the term of this patent is extended or adjusted under 35 U.S.C. 154(b) by 87 days.

(21) Appl. No.: 12/437,916

(22) Filed: May 8, 2009

(65) Prior Publication Data

US 2010/0282379 A1 Nov. 11, 2010

(51) Int. Cl.
*A45C 3/08* (2006.01)
*A45C 13/00* (2006.01)

(52) U.S. Cl.
CPC ..... *A45C 13/002* (2013.01); *A45C 3/08* (2013.01)

(58) Field of Classification Search
CPC ..... A45C 13/002; A45C 3/08
USPC ..... 150/105, 154, 107, 159, 103, 104, 106; 190/26, 102, 107, 108; 383/111, 2, 4, 383/37, 75; 224/153
See application file for complete search history.

(56) References Cited

U.S. PATENT DOCUMENTS 1,207,533 A * 12/1916 Gambel ..... 190/103
1,703,620 A * 2/1929 Hamilton ..... 73/427
1,731,547 A 10/1929 Stansbury
1,867,116 A 7/1932 Thornhill et al.
1,978,971 A 10/1934 Thornhill et al.
1,994,001 A * 3/1935 Lobel ..... 150/129
2,432,365 A 12/1947 Allen
2,436,237 A 2/1948 Brandt
2,647,595 A 8/1953 Meyers
2,653,640 A 9/1953 Browning
2,711,234 A 6/1955 Rubens
2,725,564 A 12/1955 Dering
2,751,955 A * 6/1956 Nahon ..... 206/315.6
2,845,974 A 8/1958 Arden
3,234,985 A 2/1966 Stephen
3,314,464 A 4/1967 Veiluex
3,349,992 A * 10/1967 Skinner ..... 150/154
3,726,329 A * 4/1973 Dean ..... 150/111
3,830,348 A * 8/1974 Ohyama ..... 190/107
3,901,360 A 8/1975 Cook
4,011,898 A * 3/1977 Hubbard ..... 150/107
4,026,339 A 5/1977 Burke
4,112,991 A * 9/1978 Barbaresi ..... 150/104
4,114,234 A * 9/1978 Hogenson ..... 16/411
4,404,687 A * 9/1983 Hager ..... 2/94
4,716,947 A * 1/1988 Haddock ..... 150/106
4,761,012 A * 8/1988 Dames ..... 280/38
4,953,674 A * 9/1990 Landes ..... 190/108
5,083,644 A * 1/1992 Collins, III ..... 190/26
5,154,332 A * 10/1992 Williams et al. ..... 224/153
5,172,795 A 12/1992 Riceman
5,195,828 A * 3/1993 Bush-Rodriquez ..... 383/4
2,051,092 A 7/1993 Aaron (Continued)

FOREIGN PATENT DOCUMENTS

JP 2003164313 A * 6/2003

*Primary Examiner* — Sue A Weaver
(74) *Attorney, Agent, or Firm* — Muskin & Farmer LLC

(57) ABSTRACT

A protective cover for handbags and like objects is provided, which comprises a portable and self-contained storage pouch. The protective cover can be attached to the exterior of a handbag by various mechanisms and can comprise one or more carrying straps. The protective cover can be made from a durable, water resistant and germ resistant material capable of preventing dirt, moisture and harsh chemicals from reaching the handbag. This protective cover can also prevent germ contamination of the handbag or other surfaces by removing it from the handbag and washing it after use.

5 Claims, 6 Drawing Sheets

(56) References Cited

U.S. PATENT DOCUMENTS

| | | | | | |
|---|---|---|---|---|---|
| 5,289,906 | A * | 3/1994 | Guidi | 190/107 |
| 5,293,975 | A | 3/1994 | Howorka | |
| 5,399,020 | A * | 3/1995 | Cheng | 383/4 |
| 5,439,153 | A | 8/1995 | Murdoch et al. | |
| 5,507,332 | A * | 4/1996 | McKinnon | 150/159 |
| 5,547,051 | A | 8/1996 | Bartscht et al. | |
| 5,564,539 | A * | 10/1996 | Duensing | 190/107 |
| 5,692,660 | A * | 12/1997 | Stewart | 224/581 |
| 5,704,528 | A * | 1/1998 | Faure | 224/583 |
| 6,179,025 | B1 | 1/2001 | Sutton | |
| 6,652,145 | B2 * | 11/2003 | Valdez | 383/102 |
| 7,197,893 | B2 * | 4/2007 | Trinh et al. | 62/530 |
| 7,607,461 | B2 * | 10/2009 | Pace et al. | 150/105 |
| 2001/0038023 | A1 * | 11/2001 | Trevino | 224/153 |
| 2002/0179211 | A1 * | 12/2002 | Neal et al. | 150/154 |
| 2003/0098108 | A1 * | 5/2003 | Littlefield | 150/106 |
| 2003/0147528 | A1 * | 8/2003 | Pfaff | 379/451 |
| 2006/0090824 | A1 | 5/2006 | Kreft | |
| 2006/0207698 | A1 * | 9/2006 | Adams | 150/154 |
| 2006/0228051 | A1 * | 10/2006 | Yu | 383/2 |
| 2007/0102460 | A1 | 5/2007 | Lottman | |
| 2007/0108240 | A1 * | 5/2007 | Berger | 224/153 |
| 2008/0149235 | A1 * | 6/2008 | Jay | 150/143 |
| 2008/0264531 | A1 | 10/2008 | Amante | |

* cited by examiner

PROTECTIVE COVER FOR USE WITH HANDBAGS AND A METHOD FOR ITS USE

FIELD OF THE INVENTION

The present device is a portable, self-contained protective cover designed to protect items such as purses, briefcases, valises, suitcases, portfolios and similar items made from leather, fabric or other materials, from damage caused by dirt and moisture, harsh disinfectants or other chemicals, as well as contamination of these items by germs.

BACKGROUND

It is well-known that people often carry expensive purses, handbags, computer bags and other similar objects while they are out dining, shopping, commuting to and from work, or participating in any other activity that requires them to use their valuable purses, handbags etc. outside of the clean confines of their homes. These items are subject to many environmental hazards, which can cause damage including rain, snow, dirty shopping carts, restroom floors, subway train floors and countless other dirty and wet conditions that are commonly encountered. Some of these hazards are also havens for germs which can then be carried home on the contaminated handbags, briefcases, etc. Furthermore, the dirt and water can cause significant damage to leathers, fabrics and other like materials, which often comprise these handbags, briefcases and similar objects.

What is needed is a portable, self-contained protective cover, which can be used to encase these handbags, etc. when they are subject to dirt, moisture, germs, etc. This cover must be portable so it can be easily stored, preferably on or in the item being protected while not in use. When in use the protected bag must be just as easy to carry as it would be if it were not enclosed in the protective cover. Ideally, this protective cover would be easy to deploy and remove and would be washable and reusable.

SUMMARY OF THE INVENTION

It is an aspect of the present device to provide a protective cover for the exterior of handbags, briefcases and other similar devices that can prevent damage and contamination from dirt, moisture, chemicals and germs.

The above aspects can be obtained by a protective cover comprising a bag having an inner surface and an outer surface, the bag having at least one opening capable of accepting a handbag or like item, and the bag having a connecting mechanism allowing its inner surface to be secured to the outer surface of the handbag or like item.

DETAILED DESCRIPTION

Figure 1A:
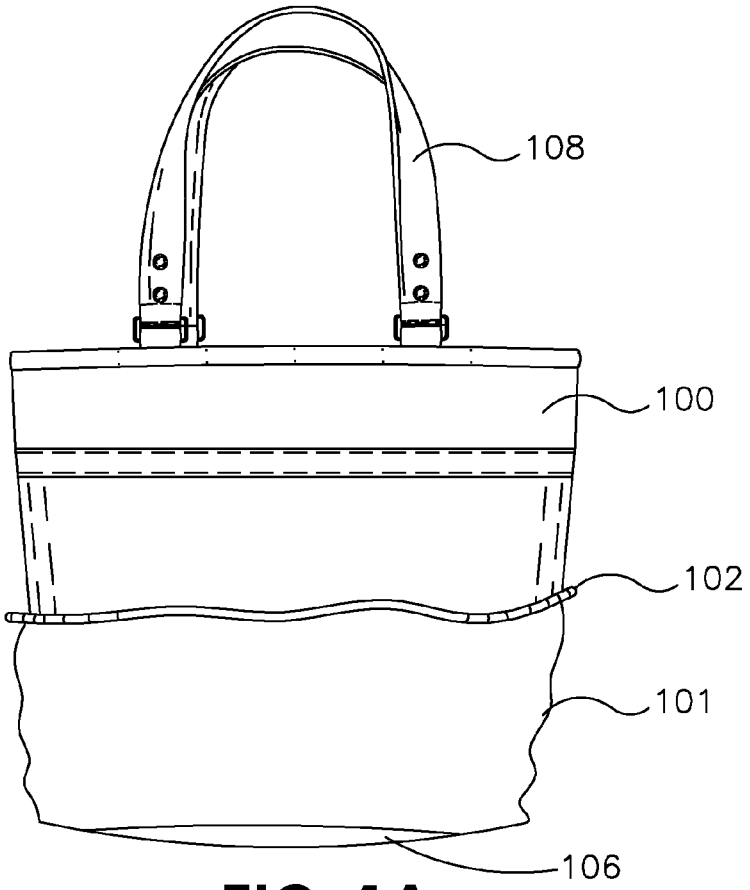
FIG. 1A is a perspective front view of a handbag that is partially covered with a protective cover that has not been fully deployed, according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Reference will now be made in detail to the presently preferred embodiments of the invention, examples of which are illustrated in the accompanying drawings, wherein like reference numerals refer to like elements throughout.

The present device should be capable of being attached to handbags, briefcases and other similar devices being protected and it should be capable of being compressed into a relatively small volume for storage and transport. The present device should also be capable of being removed easily from the item to be protected so that it can be washed after use.

FIG. 1A is a perspective front view of a handbag 100 that is partially covered with a protective cover 101 that has not been fully deployed, according to an embodiment.

Figure 1B:
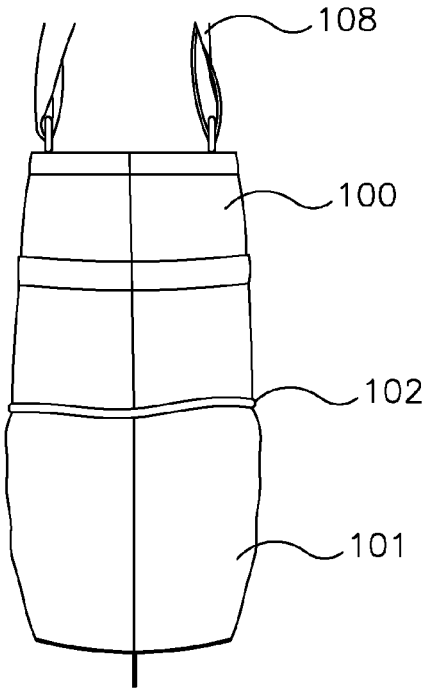
FIG. 1B is a perspective side view of a handbag that is partially covered with a protective cover that has not been fully deployed, according to an embodiment.

FIG. 1B is a perspective side view of a handbag 100 that is partially covered with a protective cover 101 that has not been fully deployed, according to an embodiment.

The exterior of a handbag 100, as depicted in FIG. 1A, can be protected from dirt, moisture, harsh chemicals and germs by the use of a portable protective cover 101. This protective cover 101 can also comprise an elastic opening 102, drawstring (not pictured), or other suitable device capable of closing the opening at the top of the protective cover 101 and helping to secure the protective cover 101 to the handbag 100 or similar device, which is being protected.

Figure 2:
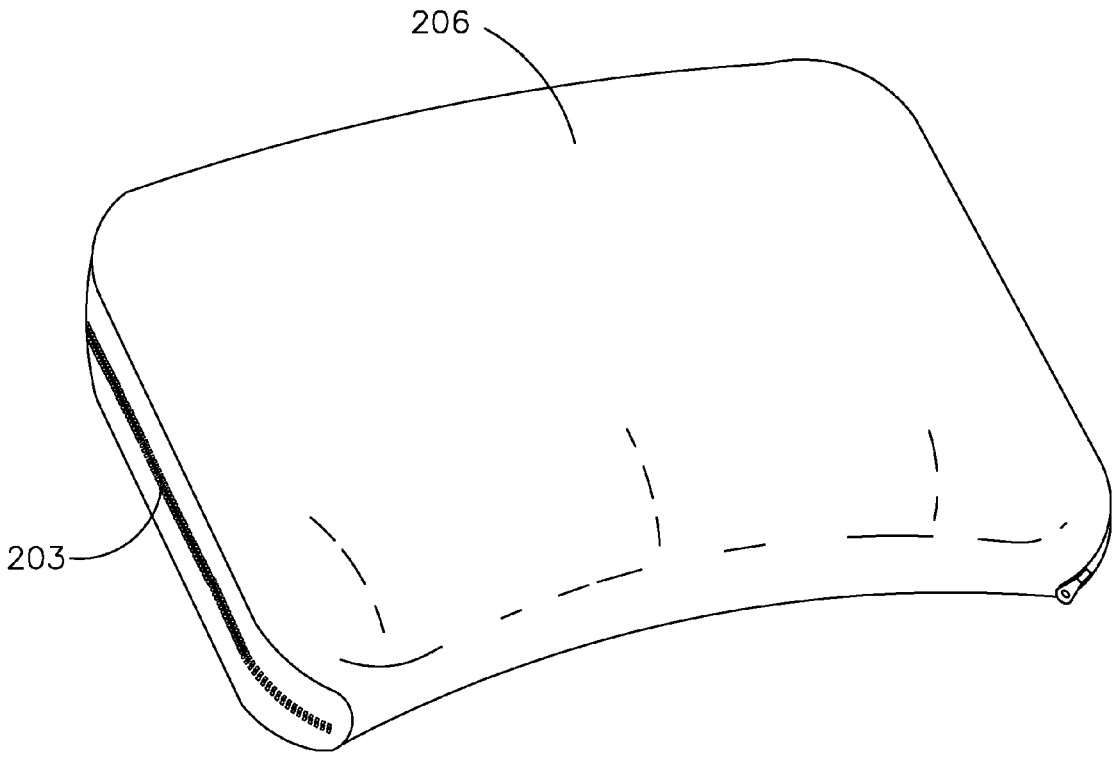
FIG. 2 is a perspective top view of a protective cover completely closed within its own storage pouch and not deployed for use, according to an embodiment.

The protective cover 101 can also feature a smaller storage pouch 106 capable of containing the entire protective cover 101 in a relatively small volume, as depicted in FIG. 2. This feature can allow the protective cover 101 to be easily stored and transported while it has not been deployed. This protector can comprise a zipper, drawstring, or similar suitable device (not pictured) capable of containing the bulk of the protective cover 101 within the smaller storage pouch 106 when the protective cover 101 is being stored. This feature allows the protective cover 101 to be stored within or connected to the handbag 100 that is to be protected.

FIG. 2 is a perspective top view of a protective cover completely closed within its own protective pouch 206 and not deployed for use, according to an embodiment.

The protective cover (not pictured) can be easily removed from the smaller storage pouch 206 through the use of a zipper 203, drawstring or other suitable connecting or cinching device (not pictured). The smaller storage pouch can also comprise a string, rope, chain or other connecting device (not pictured) to either attach the smaller pouch 206 to the handbag or other device being protected, or be used as a carrying handle.

Figure 3A:
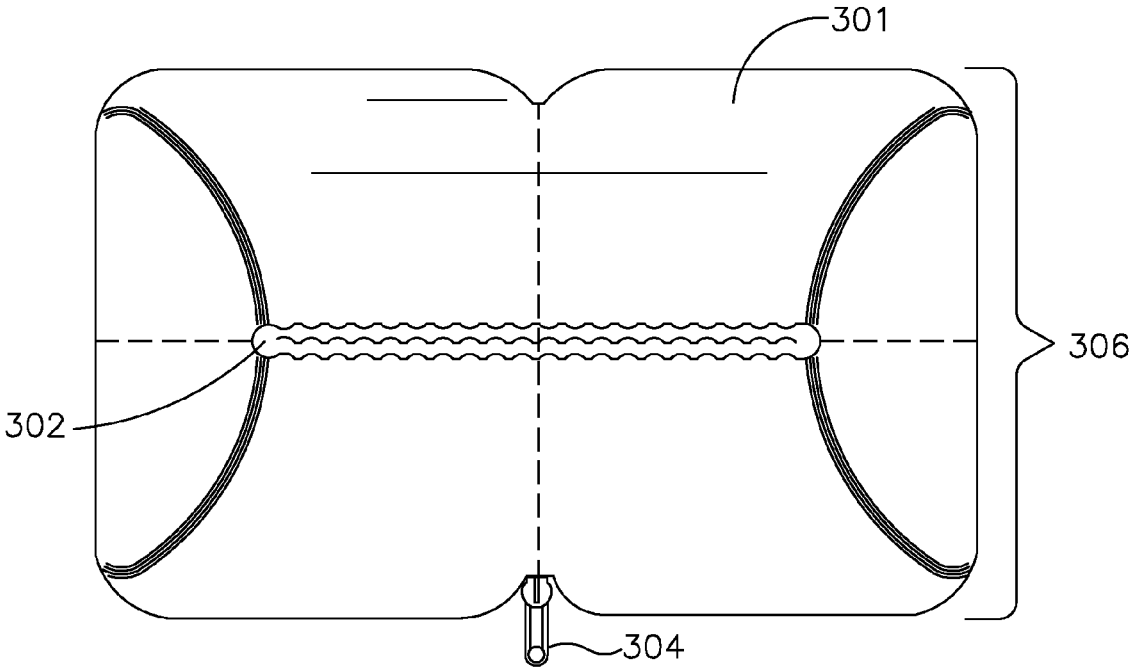
FIG. 3A is a perspective top view of a fully deployed protective cover, according to an embodiment.

FIG. 3A is a perspective top view of a protective cover 301 deployed from a smaller pouch 306, according to an embodiment.

Once the smaller storage pouch 306 is opened by unzipping the zipper 304, the protective cover 301 can be fully deployed. The elastic opening 302 can then be accessed allowing the protective cover to be placed over a handbag or similar device (not pictured).

Figure 3B:
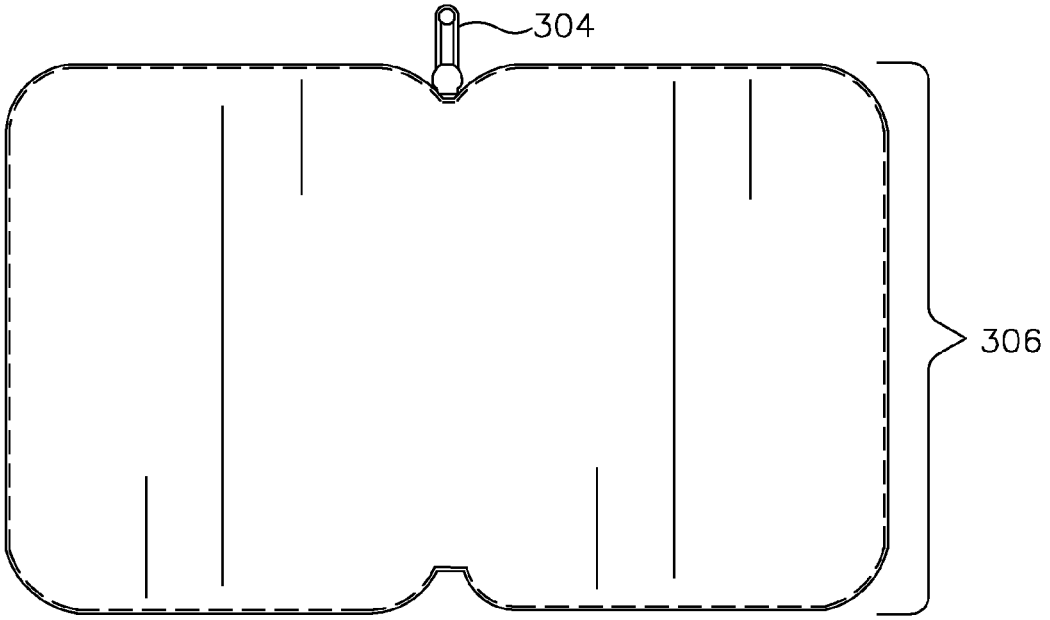
FIG. 3B is a perspective bottom view of a fully deployed protective cover, according to an embodiment.

FIG. 3B is a perspective bottom view of a protective cover deployed from a smaller storage pouch 306, according to an embodiment.

In one embodiment the smaller pouch 306, when the zipper 304 has been unzipped, as shown in FIG. 3B, can form the bottom of the protective cover (not pictured).

Figure 4:
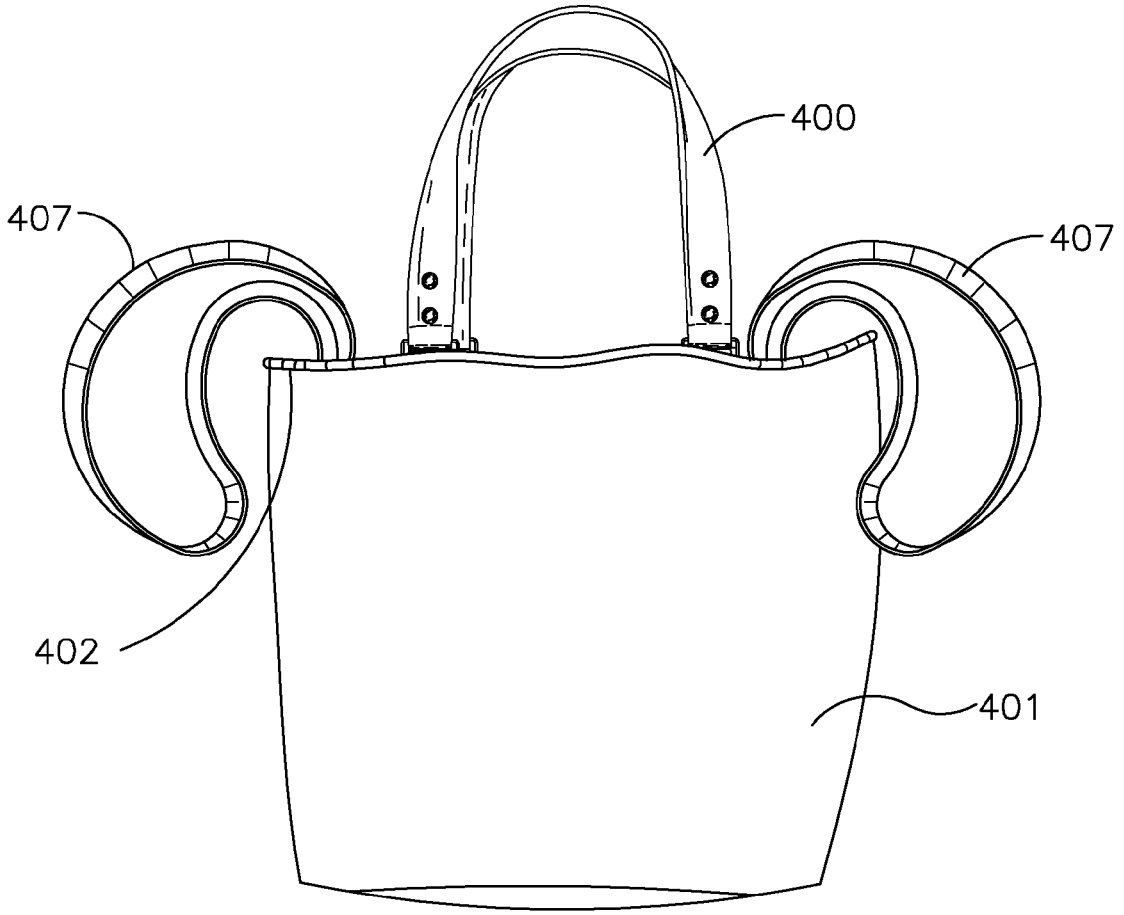
FIG. 4 is a perspective side view of a handbag being fully enclosed within a protective cover that has been fully deployed, according to an embodiment.

FIG. 4 is a perspective side view of a handbag 400 that is fully enclosed within a protective cover 401 that has been fully deployed, according to an embodiment.

A handbag 400 or similar device, which is being protected, can be inserted into the opening 402 and contained within in the protective cover 401, as depicted in FIG. 4. The protective cover 401 can comprise carrying straps 407 to be used to carry the handbag 400 or similar device once it is fully inserted into the protective cover 401. The carrying straps 407 can be used to carry both the protective cover 401 and handbag 400 to ensure that all parts of the handbag are contained within the protective cover 401. In another embodiment, the handbag's 400 own carrying strap or straps, which can be used to carry the bag 400 and the protective cover 401.

The protective cover 401 can be made of a water resistant material, which provides protection to the handbag 400 or similar device from moisture. The protective cover 401 can also be made of a material, which is resistant to germs to protect the handbag 400 or similar device from germs encountered on all surfaces. The protective cover 401 can also be made of a washable material allowing it to be washed and re-used. The protective cover 401 can also be made of a material that is transparent, translucent or designed to make the protective cover 401 aesthetically pleasing.

In another embodiment, logos and personalization can be printed on or sewn into the side of the protective cover 401.

Figure 5:
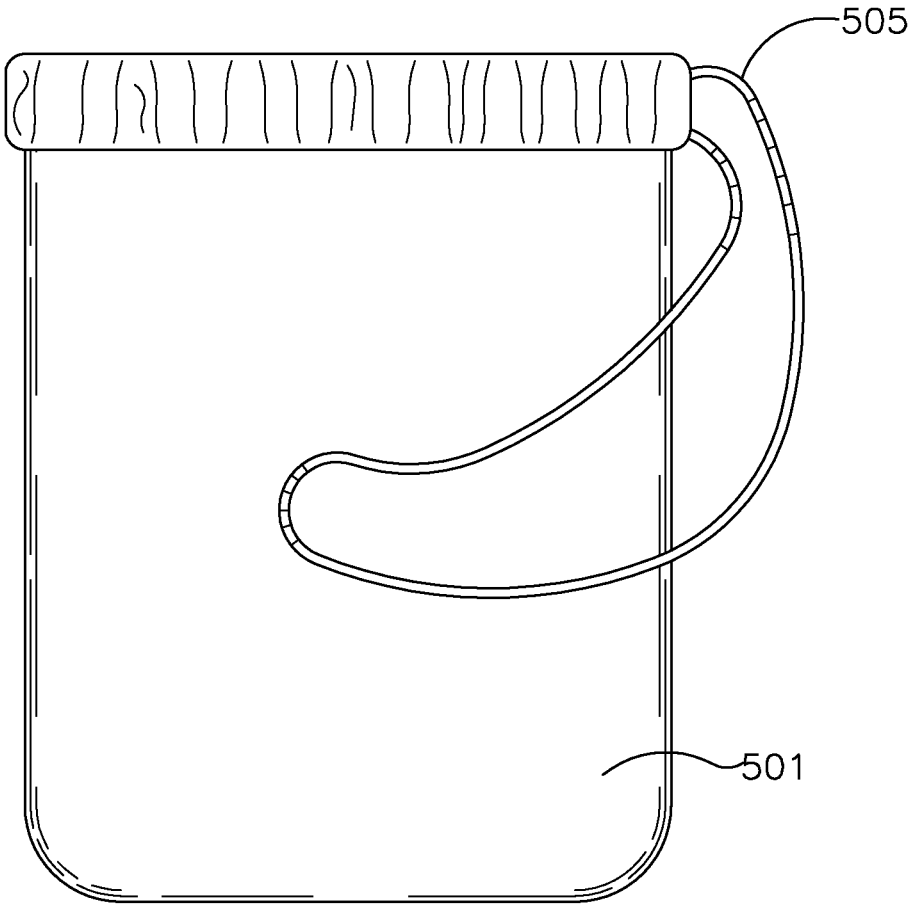
FIG. 5 is a perspective side view of a protective cover comprising a single elastic band, which can be used to connect the protective cover to the handbag, according to an embodiment.

FIG. 5 is a perspective side view of a protective cover comprising a single elastic band, which can be used to connect the protective cover to the handbag, according to an embodiment.

In this embodiment, the strap or straps of the bag being protected (not pictured) can be run through the elastic band 505 in order to attach the protective cover 501 to the bag being protected.

Figure 6:
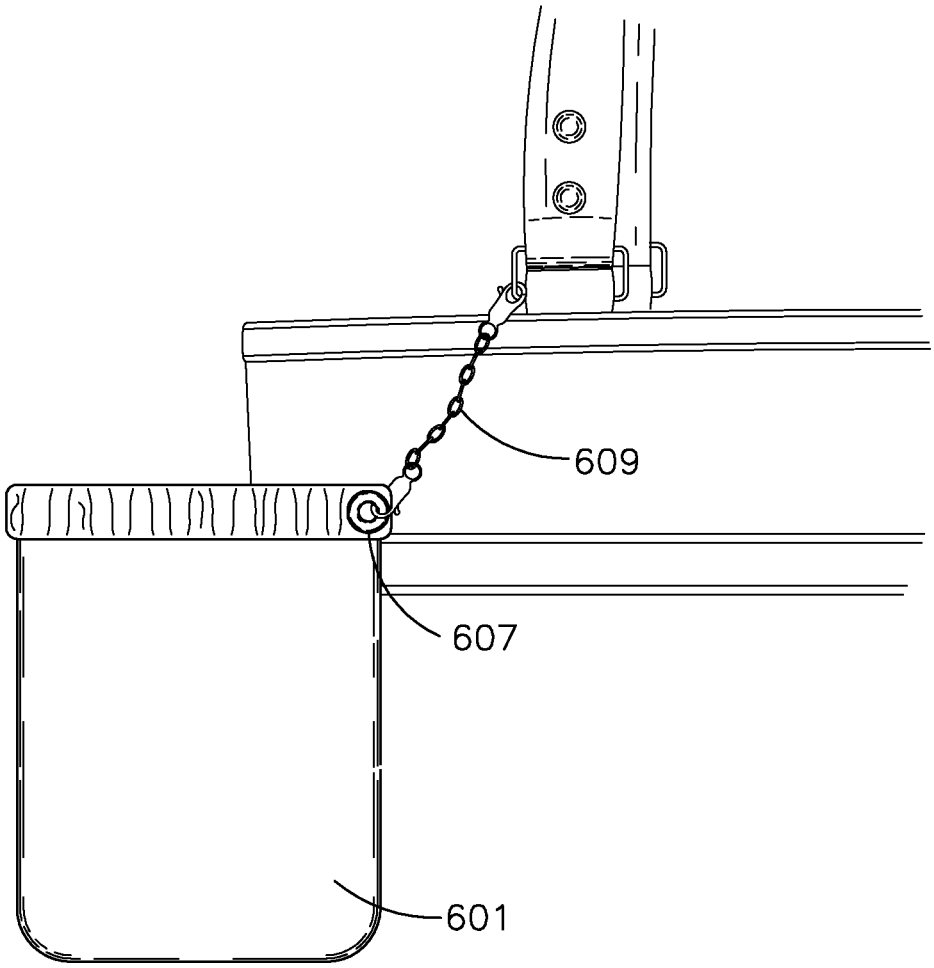
FIG. 6 is a perspective side view of a protective cover comprising a grommet, which can be used to connect the protective cover to the handbag, according to an embodiment.

FIG. 6 is a perspective side view of a protective cover 601 comprising a grommet 607, which can be used to connect the protective cover 601 to the handbag (not pictured), according to an embodiment.

Handbags, briefcases, and similar devices often comprise loops or grommets. In one embodiment the protective cover 601 can also comprise a grommet 607 which could then be used to attach the protective cover to the handbag or other device being protected. This connection could be made with a jeweler's chain 609, rope, or similar connecting device.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A protective cover comprising:

a bag, comprised of a water resistant or waterproof material, having an inner surface and an outer surface;

the bag having at least one opening capable of accepting a handbag or like item;

the bag having one or more carrying straps connected to the bag in one or more places;

the bag having a connecting mechanism comprising one or more grommets allowing the bag to be secured to the handbag or like item via a chain, rope or similar device known in the art;

the outer surface of the bag comprising a storage pouch that is connected to the bag and comprises part of the bag's outer surface;

the storage pouch having a zipper capable of containing the bag and connecting mechanism within the storage pouch;

the storage pouch forming the bottom surface of the bag when the bag is partially deployed;

a circumference of the opening configured to accept a handbag or like item comprising an elastic cinching device; and the bag configured to be secured to the handbag or like item with the contents of handbag or like item fully accessible and only a bottom portion of the handbag or like item covered by the bag;

wherein the bag also comprises a jeweler's chain connected to the bag in one or more places.

2. The protective cover recited in claim 1, wherein the opening comprises a drawstring.

3. The protective cover recited in claim 1, wherein the storage pouch is configured to be connected to the handbag or like item to be protected.

4. A method for protecting a handbag or like object, the method comprising the use of a protective cover comprising:

providing a bag, comprised of a water resistant or waterproof material, having an inner surface and an outer surface;

the bag having at least one opening configured to accept a handbag or like item;

the bag having a connecting mechanism comprising one or more grommets allowing the bag to be secured to the handbag or like item;

the bag having one or more carrying straps connected to the bag in one or more place;

the outer surface of the bag comprising a storage pouch that is integrated into a side of the bag and comprises part of the bag's outer surface;

the storage pouch having a zipper capable of containing the bag and connecting mechanism within the storage pouch;

the storage pouch forming the bottom surface of the bag when the protective cover is partially deployed;

a circumference of the opening configured to accept a handbag or like item comprising an elastic cinching device; and the bag configured to be secured to the handbag or like item with the contents of handbag or like item fully accessible and only a bottom portion of the handbag or like item covered by the bag;

wherein the protective cover is configured to prevent damage to or contamination of the handbag or like object by covering a selected portion, including either only the bottom, or the entire outer surface of said handbag or like object with the bag, wherein the inner surface of the bag is in contact with the outer surface of the handbag or like object and the bag is attached to the handbag.

5. The method for protecting a handbag or like object recited in claim 4, wherein the protective cover is configured to be removed from the handbag and washed after use.

* * * * *